US009089723B2

(12) United States Patent
Bagnaro

(10) Patent No.: US 9,089,723 B2
(45) Date of Patent: Jul. 28, 2015

(54) SAFETY PROTECTION APPARATUS FOR PERSONNEL ON OIL DRILLING DERRICKS

(75) Inventor: Perry L. Bagnaro, Oklahoma City, OK (US)

(73) Assignee: Sapheco, LLC, Oklahoma City, OK (US)

( * ) Notice: Subject to any disclaimer, the term of this patent is extended or adjusted under 35 U.S.C. 154(b) by 742 days.

(21) Appl. No.: 13/367,096

(22) Filed: Feb. 6, 2012

(65) Prior Publication Data

US 2013/0199854 A1 Aug. 8, 2013

(51) Int. Cl.
*G08B 23/00* (2006.01)
*A62B 35/00* (2006.01)

(52) U.S. Cl.
CPC ..... *A62B 35/0025* (2013.01)

(58) Field of Classification Search
CPC ..... A62B 35/0025; B25C 1/06; B25D 11/06; B25D 17/24; B25D 2250/221; E21B 47/011; E21B 47/122
USPC ..... 340/573.1, 568.1, 568.8, 571, 340/572.1–572.9, 687, 691.6, 825.49, 450, 340/450.2
See application file for complete search history.

(56) References Cited

U.S. PATENT DOCUMENTS

| | | | | |
|---|---|---|---|---|
| 3,368,182 | A | 2/1968 | Culver | |
| 4,042,797 | A | 8/1977 | De Araujo et al. | |
| 4,474,263 | A * | 10/1984 | Christopher | 182/10 |
| 4,803,321 | A | 2/1989 | Lefebvre | |
| 5,959,270 | A | 9/1999 | Wecke et al. | |
| 6,268,574 | B1 | 7/2001 | Edens | |
| 6,568,950 | B2 | 5/2003 | Rudoy et al. | |
| 6,867,382 | B2 | 3/2005 | Hoffman | |
| 7,070,417 | B2 | 7/2006 | Meleck et al. | |
| 7,405,374 | B2 | 7/2008 | Thomas et al. | |
| 7,605,335 | B2 | 10/2009 | Hiltl et al. | |
| 7,709,756 | B2 | 5/2010 | Poyner et al. | |
| 7,823,656 | B1 * | 11/2010 | Williams | 175/38 |
| 2002/0140554 | A1 * | 10/2002 | Mosing et al. | 340/540 |
| 2004/0090418 | A1 | 5/2004 | Ceremony et al. | |
| 2007/0023263 | A1 * | 2/2007 | Day | 200/43.04 |
| 2008/0023307 | A1 | 1/2008 | Kerr | |
| 2010/0063888 | A1 * | 3/2010 | Sajkowsky | 705/17 |
| 2011/0302869 | A1 * | 12/2011 | Vogt et al. | 52/651.05 |

* cited by examiner

*Primary Examiner* — Daniel Previl
(74) *Attorney, Agent, or Firm* — Hall Estill Law Firm

(57) ABSTRACT

A safety apparatus for personnel on an oil drilling rig includes a cylindrical quick disconnect switch having a receptacle and a plunger. The receptacle has an open circuit pair of electrical wires. The plunger is configured to attach to a derrick man. The plunger and the receptacle are configured to mate when the plunger is inserted into the receptacle and to remain frictionally mated until pulled apart. The mating results in closing the circuit between the pair of electrical wires.

10 Claims, 9 Drawing Sheets

SAFETY PROTECTION APPARATUS FOR PERSONNEL ON OIL DRILLING DERRICKS

BACKGROUND OF THE INVENTION

This invention relates generally to safety protection devices and more particularly to methods and apparatus for protecting personnel on an oil drilling derrick.

Oil and gas exploration has been a hazardous undertaking since it began more than 150 years ago. During modern drilling rig operations, one of the times of greatest risk to personnel is when the rig is either running pipe into the well or pulling pipe out of the well. The "derrick man" is positioned up in the derrick (approximately 30 m) on a standard triple stand derrick. His job is to pull and rack the stands (three lengths of pipe joined together) of pipe into the racking board so the stands can be stored in an orderly arrangement. He is required to extend himself out from the racking board, retrieve the top of the stand, and guide it onto the racking board. The rig is usually equipped with at least one of several fall restraint and fall arrest devices in the event he should fall off the racking board. These could include devices such as a full body harness or fail arrest retracting device.

At times, the derrick man may forget to or is distracted from attaching to the fall protection system. This lack of attention could cause the derrick man to be severely injured, perhaps even fatally injured. Also, his fall may present a serious hazard to personnel on the rig floor.

Nevertheless, in normal drilling operations, personnel may be required to be in areas or jobs that are inherently hazardous. There are many safety systems on the market that are or can be effective if they are in proper and continuous use. However, rig operations start and stop repeatedly during any working shift. Thus, it is common for the derrick man to take his safety equipment off and on during his shift for breaks, for comfort while waiting on rig maintenance, to perform other functions that cannot be performed while hooked to the safety gear, or for other reasons. When operations restart, the derrick man may or may not remember to reattach all of his safety gear.

The person on the rig who is in charge of controlling operations is the driller. The driller cannot see all of the personnel involved in rig operations from his location, including the derrick man who may be located 30 m above him. Thus, the driller presently has no way of verifying that the derrick man is properly harnessed and ready to work every time rig operations are restarted.

Every known drilling company has specific policies regarding personnel safety during rig operations. OSHA also has regulations relating to these same issues. Insurance companies providing workers' compensation insurance have requirements for safety equipment that insureds must meet. But ultimately, safety depends upon whether personnel follow company policy and use the provided safety equipment.

Truly safe operations depend upon each of the rig hands being where they are supposed to be for any given rig operation. Because the driller is rarely, if ever, in a position to verify the location of all of the members of the crew during operations, it would be desirable to provide a comprehensive approach to monitoring crew behavior and location.

It is thus also be desirable to provide apparatus to make drilling operations safer. It is also desirable to provide apparatus that assist in changing the behavior of personnel to make safety systems more effective.

SUMMARY OF THE INVENTION

In one aspect, some configurations of the present invention therefore provide a safety apparatus for personnel on an oil drilling rig. The safety apparatus includes a cylindrical quick disconnect switch having a receptacle and a plunger. The receptacle has an open circuit pair of electrical wires. The plunger is configured to attach to a derrick man. The plunger and the receptacle are configured to mate when the plunger is inserted into the receptacle and to remain frictionally mated until pulled apart. The mating results in closing the circuit between the pair of electrical wires.

In another aspect, some configurations of the present invention provide a safety apparatus that includes a quick-disconnect switch. The quick-disconnect switch has at least a first part attachable to a derrick man and a second part located on a drill pipe stand near a piece of safety protection equipment. The quick-disconnect switch is operable by a derrick man to indicate that he or she is in position and protected by the piece of safety protection equipment. A light panel in electrical communication with the quick-disconnect switch is also provided. The light panel is located in a position visible by a driller located under the drill pipe stand and is configured to indicate when the quick-disconnect switch is open or closed by the derrick man.

In yet another aspect, some configurations of the present invention provide a safety apparatus on an oil derrick. The safety apparatus includes a plurality of radio frequency identification (RFID) tags. Each RFID tag assigned to crew members on the oil derrick. Also provided is a plurality of sensors and/or antennae located on the oil derrick that are configured to track and report the location of each said RFID tag. In addition, a control panel having at least one indicator is provided. The control panel is responsive to the location reports and the indicator or indicators are configured to indicate, to a driller, when needed crew members are present and in locations in which the crew members are supposed to be for an operation of the oil derrick being undertaken.

It will be appreciated that some configurations of the present invention provide a comprehensive approach to monitoring crew behavior and location. It will also be appreciated that some configurations of the present invention provide apparatus to make drilling operations safer, and/or that assist in changing the behavior of personnel to make safety systems more effective.

The foregoing summary, as well as the following detailed description of certain embodiments of the present invention, will be better understood when read in conjunction with the appended drawings. To the extent that the figures illustrate diagrams of the functional blocks of various embodiments, the functional blocks are not necessarily indicative of the division between hardware circuitry.

DETAILED DESCRIPTION OF THE INVENTION

As used herein, an element or step recited in the singular and proceeded with the word "a" or "an" should be understood as not excluding plural said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

Figure 1:
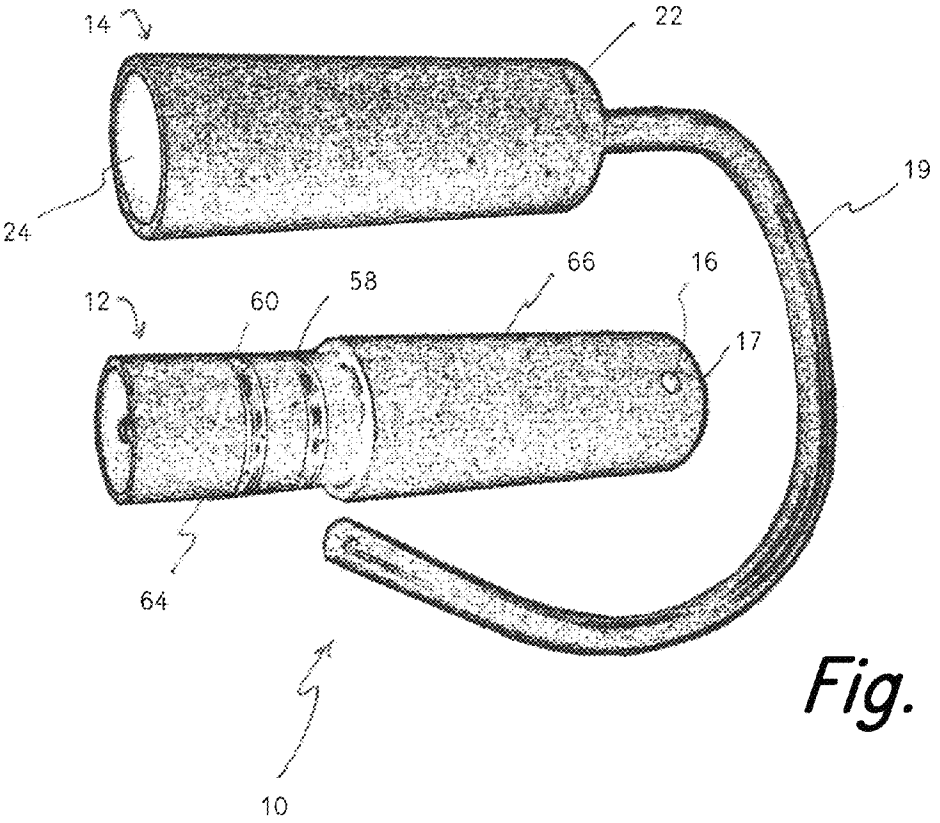
FIG. 1 is a pictorial view of a quick-disconnect switch embodiment.

Referring now to FIG. 1, some configurations of the present invention provide a quick-disconnect switch 10 that comprises two generally cylindrical components, namely a plunger 12 and a receptacle 14. In some embodiments, plunger 12 includes a lateral hole 16 near an outside end 17 of plunger 12. Hole 16 is provided as an attachment point to allow a strap or loop to enter for attachment of switch 10 to a harness or other item of clothing (not shown in FIG. 1).

Figure 2:
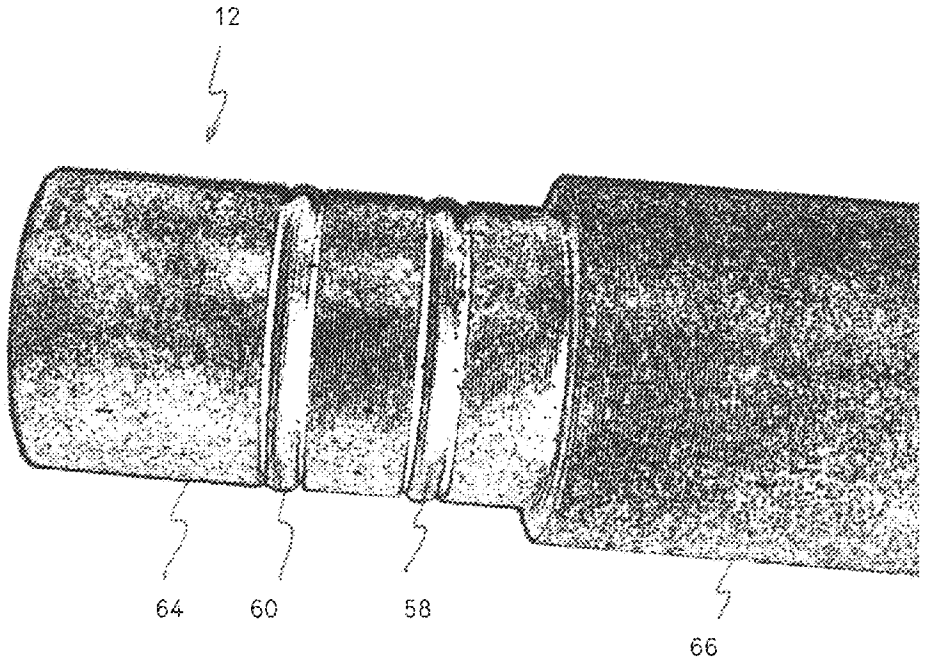
FIG. 2 is a close-up pictorial view of the reduced diameter male portion of the switch plunger shown in FIG. 1.

Receptacle 14 includes a first portion comprising a cap 22 having two wires passing therethrough. In FIG. 1, these two wires are enclosed in a sheath or plastic tube 19. Receptacle 14 also has a second, female portion 24 that mates with a reduced diameter, male portion 64 of plunger 12. To provide a watertight as well as frictional fit, at least one, and in the illustrated embodiment two, rubber O-rings 58 and 60 are fitted into grooves in male portion 64 of plunger 12. O-rings 58 and 60 are seen to best advantage in FIG. 2. In some embodiments, O-rings 58 and 60 may also act to resist the accidental separation of plunger 12 from receptacle 14 due to an air seal formed by the O-rings.

Figure 3:
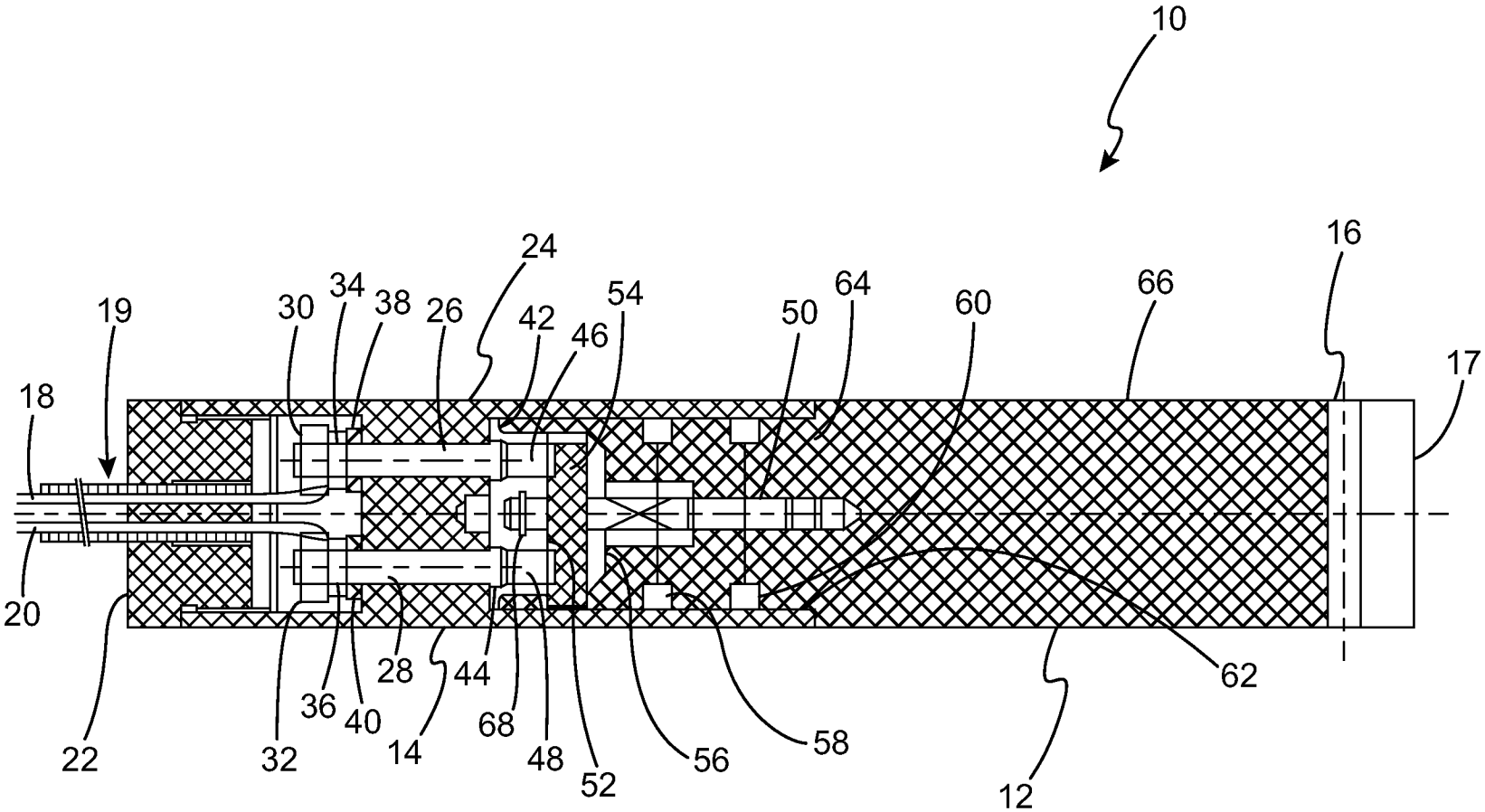
FIG. 3 is an axial cut-away view of the quick-disconnect switch of FIG. 1.
Figure 4:
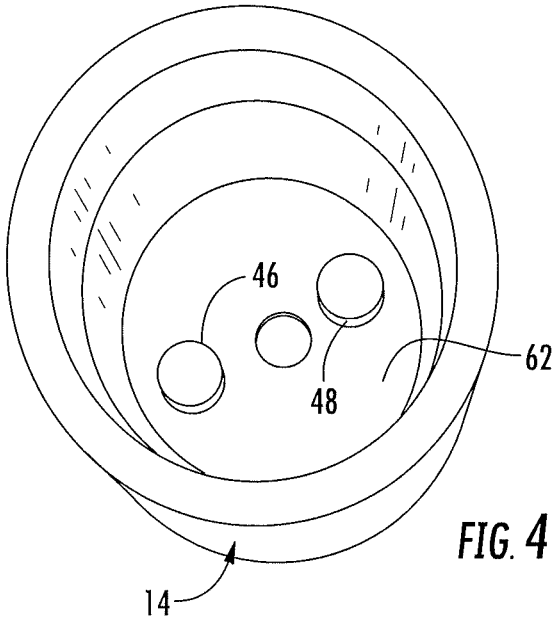
FIG. 4 is a pictorial view into the female portion of the switch receptacle shown in FIG. 1.

In some embodiments and referring to FIG. 3, a female portion 24 of receptacle 14 has two hollow insulators 26 and 28 passing in an axial direction therethrough. Widened rims 42 and 44 and round fasteners 38 and 40 hold hollow insulators 26 and 28 in place. respectively. Threaded conducting rods 34 and 36 pass internally through insulators 26 and 28, respectively, and are directly connected to wires 18 and 20, respectively, using tightened nuts 30 and 32, respectively. Wires 18 and 20, when not electrically connected, are an open circuit pair of wires. An opposite end of rods 34 and 36 form electrical contacts or posts 46 and 48, respectively. Posts 46 and 48 project a slight distance above an internal floor of a hollow portion 62 of receptacle 14 as can readily be seen in the pictorial view of FIG. 4.

Figure 5:
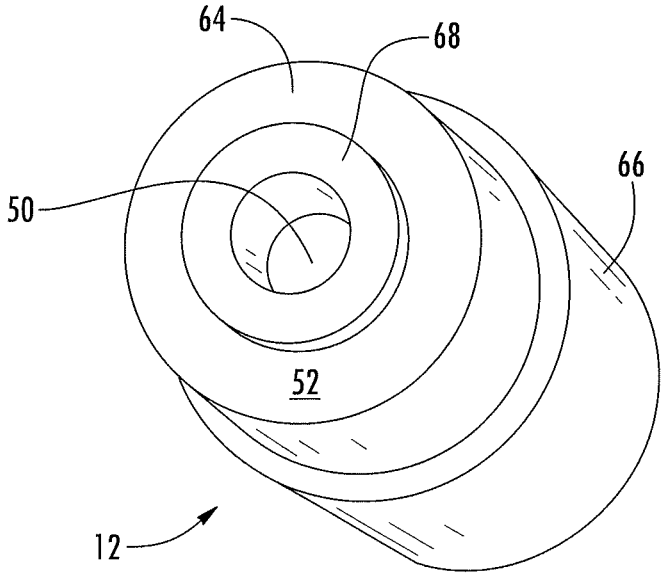
FIG. 5 is a pictorial view into the reduced diameter male portion of the switch plunger shown in FIGS. 1 and 2.

Referring again to FIG. 3, plunger 12 includes a reduced diameter portion 64 and a full diameter portion 66. In some embodiments, full diameter portion 66 has the same outside diameter as that of receptacle 14. Reduced diameter portion 64 is configured to tightly, yet slidingly engage hollow portion 62 of receptacle 14. A post 50 is embedded in an axis of cylindrical plunger 12. An e-clip 68 on post 50 holds a retainer 56 against a wall in a hollowed-out portion of plunger 12. A resilient spongy or compressible disk 54 through which post 50 passes is affixed on one side to a face of retainer 56 facing towards posts 46 and 48, with a conductive, flat annulus 52 affixed to the other side of disk 54. Annulus 52 is best seen in the pictorial view of FIG. 5. Preferably, conductive, flat annulus 52 comprises a flexible, but resilient, metallic sheet. Together (or separately, in some embodiments), disk 54 and annulus 52 are biased towards posts or terminals 46 and 48 to eliminate the need for posts 46 and 48 to be precisely the same length. One or more O-rings 58 and 60 are seated in grooves around reduced diameter portion 64 of plunger 12 and provide some frictional resistance to the separation of plunger 12 from receptacle 14 or a relatively air-tight seal to provide such resistance, or both. The frictional resistance prevents plunger 12 and receptacle 14 from simply sliding apart, but allows separation to occur easily when plunger 12 and receptacle 14 are pulled apart, either deliberately or when a force pulls on the lanyard or strap through hole 16.

In some embodiments and referring again to FIG. 3, when plunger 12 is inserted into receptacle 14, electrical contact is completed between posts 46 and 48 through conductive, flat annulus 52. Thus, there is a completed electrical path between wires 18 and 20 in this condition. When plunger 12 is pulled from receptacle 14, this path is broken, and there is no complete electrical path between wires 18 and 20. Thus, when a lanyard or strap is attached to plunger 12 through hole 16 and wires 18 and 20 are electrically communicating with an alarm system, quick-disconnect switch 10 can be used to indicate an alarm condition by the separation of plunger 12 from receptacle 14.

In one embodiment, quick disconnect switch 10 has a diameter of about 27 mm and FIG. 3, for this embodiment, is drawn approximately to scale. However, neither the diameter nor the length of quick disconnect switch 10 are critical elements of the present invention. In particular, FIG. 3 does not necessarily represent either the diameter or the relative dimensions of components of quick disconnect switch in all embodiments of the invention. The dimensions of any particular quick disconnect switch may be left as a design choice to one of ordinary skill in the art upon obtaining an understanding of the present invention from this description and the accompanying drawings.

Figure 6:
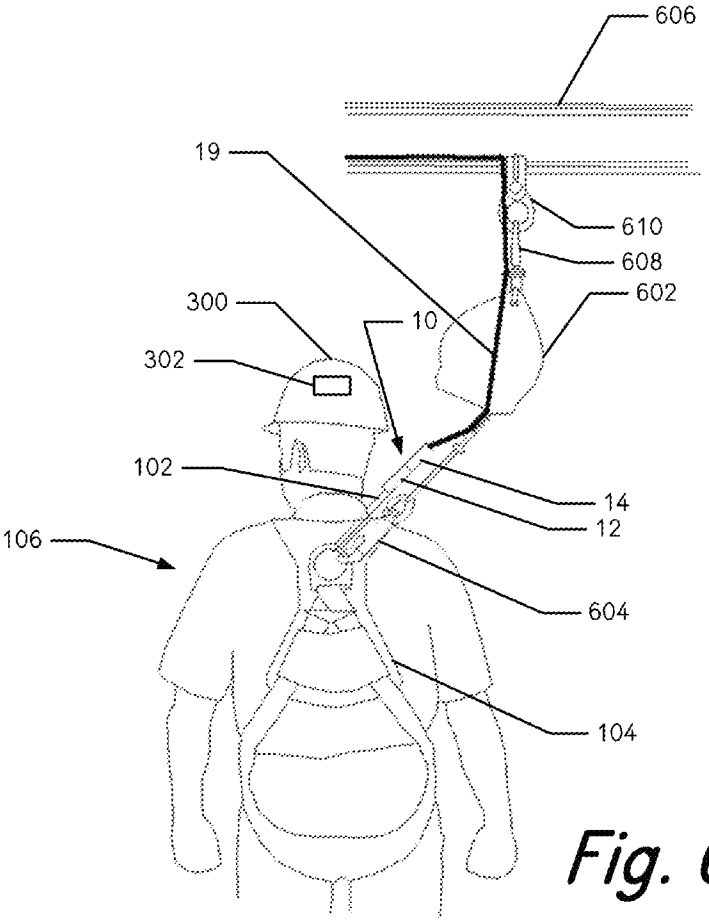
FIG. 6 is a pictorial view of the quick-disconnect switch of FIG. 1 attached to a safety vest on a derrick man. Also shown is a hard hat carrying a radio frequency identification (RFID) tag.

In one configuration of the present invention and referring to FIG. 6, quick disconnect switch 10 is attached by a lanyard 102 to a safety vest 104 worn by a derrick man 106 or other worker. Lanyard 102 loops through hole 16 (shown in FIGS. 1 and 2) in plunger 12. Receptacle 14 attaches via cable 19 to electrical equipment not shown in FIG. 6. In some embodiments, receptacle 14 is tethered in place to the electrical equipment by cable 19. When derrick man 106 arrives at a job site, he or she puts on vest 104 (which has lanyard 102 and plunger 12 attached thereto) and inserts plunger 12 into receptacle 14 to provide a "safe" indication to the electrical equipment. When derrick man 106 wants to indicate an "unsafe" condition, he or she pulls plunger 12 from receptacle 14. In another embodiment, if the worker is pulled, pushed, or otherwise displaced from a safe position, plunger 12 is pulled out of receptacle 14 without further intervention by derrick man 106 by movement of safety vest 104 and lanyard 102. In the embodiment shown in FIG. 6, electrical cable 19 is tied to a safety cable 600 of a connecting device 602 that attaches to safety vest 104 using a first detachable hook 604. Connecting device 602 itself connects to an anchorage 606 such as an I-beam using a second hook 608 (not necessarily easily detachable) and an anchorage connector 610 that is affixed to an anchorage 606. Cable 19 can also be attached to anchorage 606 and routed to electrical equipment (not shown in FIG. 6). In this particular embodiment and in some other embodiments, a "safe" condition can only be indicated when derrick man 106 is at least in proximity to the safety cable 600 of connecting device 602.

Figure 7:
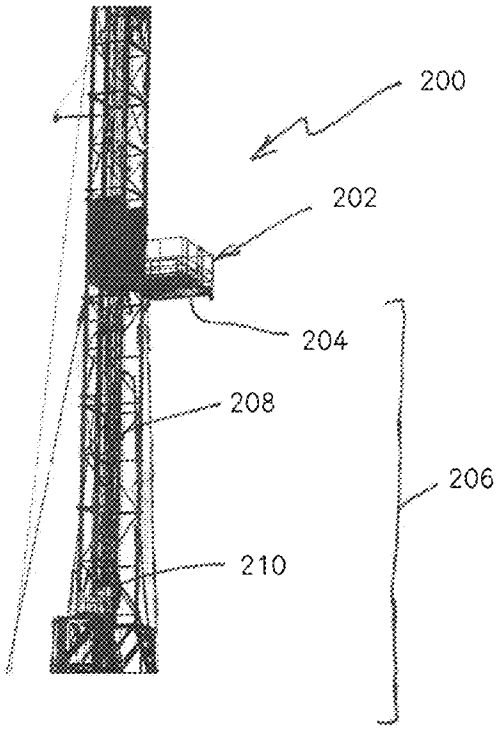
FIG. 7 is a pictorial view of a portion of an oil derrick on which the derrick man is located while working.
Figure 8:
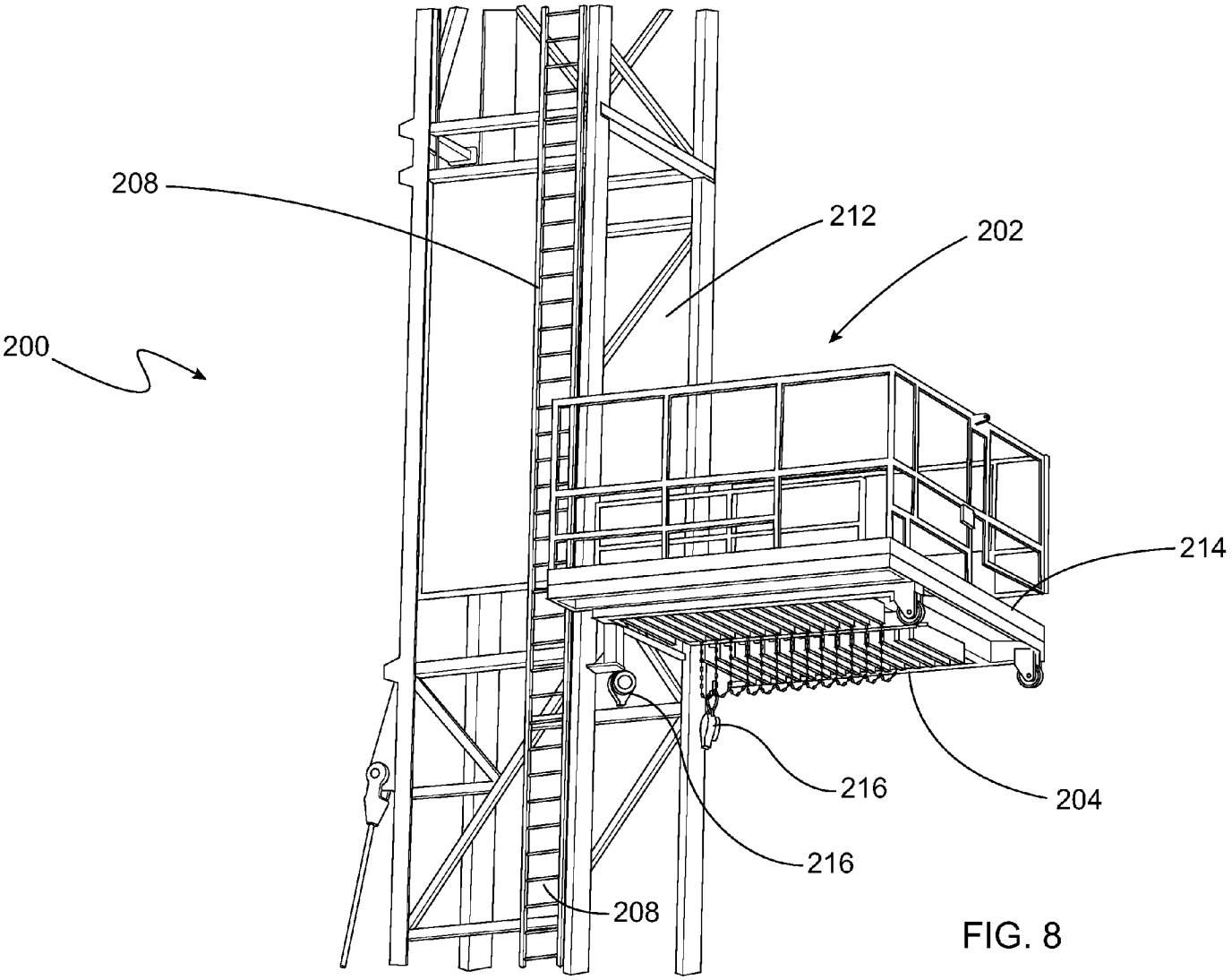
FIG. 8 is a close up pictorial view of the location at which the derrick man works on the oil derrick of FIG. 7.
Figure 9:
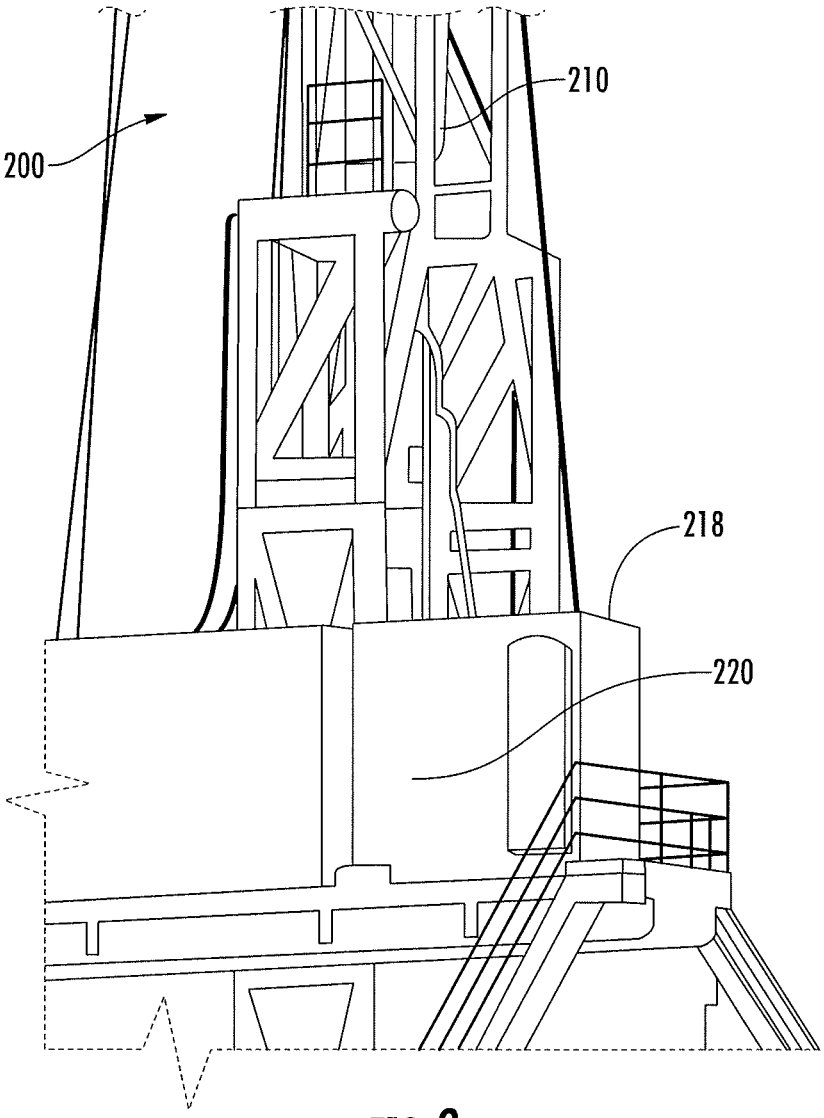
FIG. 9 is a pictorial view of the bottom portion of the oil derrick of FIG. 7, showing a light panel inside a driller's shelter.

In some embodiments and referring to FIGS. 7, 8 and 9, derrick man 106 is located on an oil drilling rig 200. Drilling rig 200 works on a drill pipe stand 202 that has a finger board 204 that keeps drill pipe stands 202 separated. Drill pipe stand 202 also has a racking board 214 that is used to rack stands of drill pipe when worker 106 is making a trip to change a drill bit or to install a different drilling tool. The racking board is usually about 24 to 30 meters above the floor, as indicated by bracket 206. On most drilling rigs 200, derrick man 106 climbs up a ladder 208 to reach racking board 214 to enter an open or "working" side 212 of derrick 200. A traveling block 210 is used to pull pipe out of a well and return it to the floor of drilling rig 200.

Derrick man 106 works on racking board 214 when the rig is "tripping" pipe into or out of a well. He is constantly walking from the outside or back of racking board 214 to the open or working side 212 of derrick 200. In some embodiments, a block 216 (such as a DBI/SALA® brand fall protection device, available from D B Industries, Inc., Red Wing, Minn.) is used to provide a measure of protection for derrick man 106 when he is climbing derrick 200. Once at racking board 214, derrick man 106 transfers himself to another block (not shown in the Figures) attached to the top of derrick 200.

Once derrick man 106 is in position, he engages switch 10 (not shown in FIG. 7, 8 or 9), which is wired to a light panel 220 below in driller's shelter 218. This engagement completes an electrical circuit that provides a visual indication on light panel 220 to the driller that derrick man 106 has attached the appropriate block 216 to his harness and is ready to resume operations.

Sometimes due to a stop in running the pipe, derrick man 106 may unhook or sit and wait for operations to resume. With switch 10 disengaged, the driller knows not to raise the traveling block 216 (lifting or lowering the drill string) until derrick man 106 confirms through light panel 220 that he is hooked up to his fall protection. In some embodiments, switch 10 can also (or alternately) be used to signal equipment for automatic cut-off. Also, in some embodiments, an alarm or light remains actuated until switch 10 is reengaged.

In some embodiments of the present invention, a horn (not shown in the drawings) is provided in addition to light panel 220, and engagement of switch 10 also (at least momentarily) sounds the horn as a signal to the driller.

In some embodiments of the invention, switch 10 is designed for rugged conditions, and is shock-resistant, water-tight, and/or corrosion resistant. For example, the cylindrical metallic parts of switch 10 may comprise anodized aluminum, and rubber O-rings 58 and 60 provide a water-tight seal.

In some embodiments of the invention, switch 10 comprises a two-piece unit having a plunger 12 and a receptacle 14. Receptacle 14 is attached to rig 200 at an appropriate location and plunger 12 is attached to derrick man 106. When plunger 12 and receptacle 14 are joined together, a switch is tripped and a circuit is completed. The signal generated by the completed circuit is used to alert the driller that derrick man 106 is properly harnessed and prepared to begin rig operations.

In some embodiments, receptacle 14 and plunger 12 are held together by friction. When plunger 12 is properly inserted into receptacle 14, an electrical contact is made within switch 10 and a circuit completed. Plunger 12 and receptacle 14 are each anchored to its respective piece of the safety harness system with enough lead to permit plunger 12 and receptacle 14 to be joined together only when the safety equipment is properly in place. In one embodiment, the completed circuit (or a relay or electronic switch controlled thereby) turns a red light on light panel 220 to green, thereby letting the driller know that the derrick man is ready for operations. If the derrick man removes his safety harness, plunger 12 is necessarily removed from receptacle 14, breaking the circuit and changing the green light to red.

Figure 10:
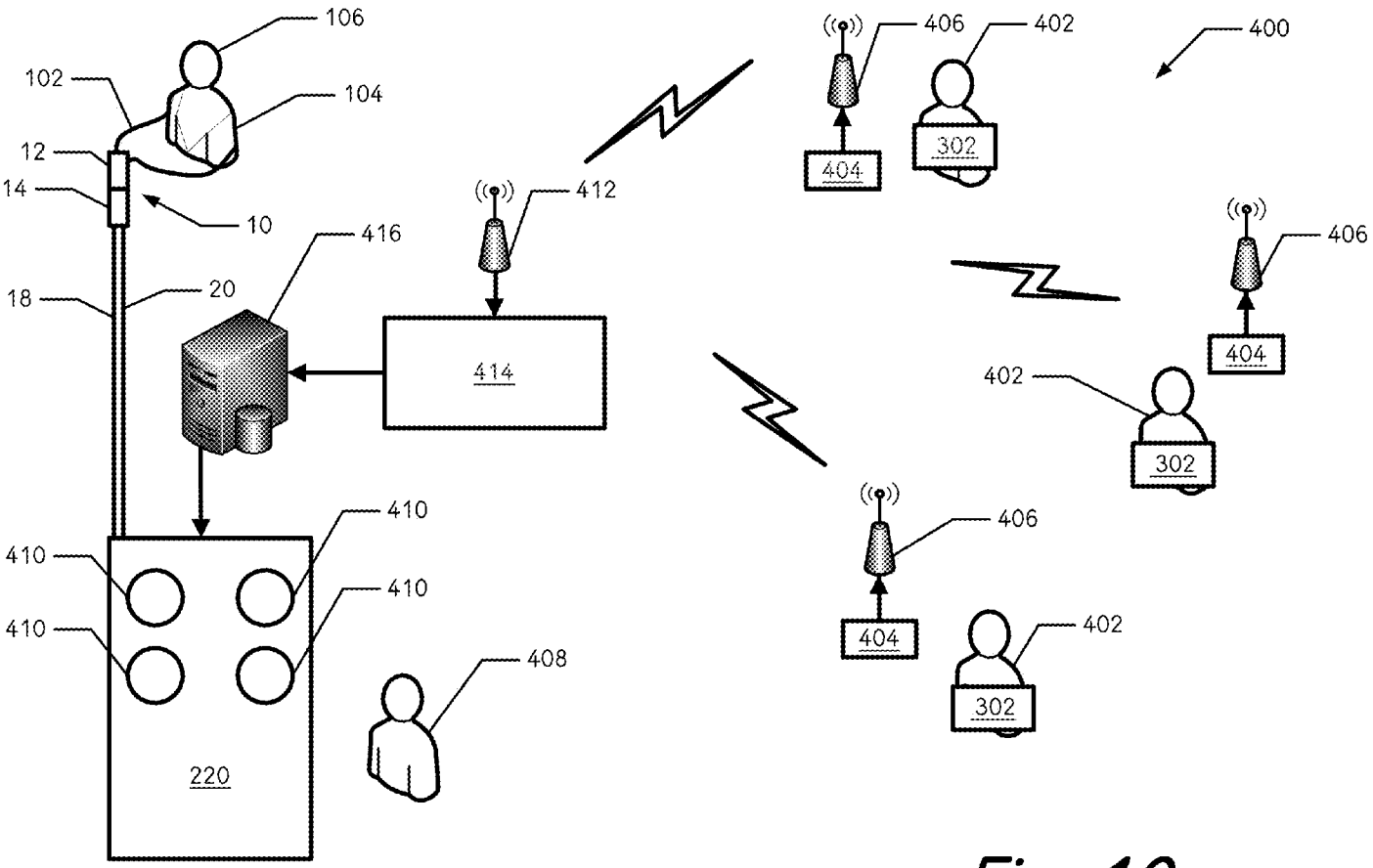
FIG. 10 is a pictorial schematic diagram of an embodiment of a safety protection system of the present invention.

In some embodiments of the present invention and referring to the block schematic drawing of safety system 400 of FIG. 10, various crew members 402 are required to be in different locations around rig 200. In these embodiments, proximity technology is combined with switch 10 to relay information to driller 408 regarding the location of each crew member 402, which may also include derrick man 106. When the responsible crew member 402 is where he or she is supposed to be for the operation being undertaken, driller 408 is notified by a signal, such as a red light 410 turning green on panel 220. Only when all lights 410 are green would the driller 408 begin rig operations.

For example, and referring to FIGS. 6 and 10, a radio frequency identification (RFID) tag 302 is assigned to each crew member 402 (which may, but need not necessarily include derrick man 106). RFID technology is suitable for this purpose because it can be used in harsh environments and tuned for distance. Either active or passive RFID tags 302 are suitable. The use of RFID tags 302 permits data acquired to be passed to databases 416 that can record histories and/or determine safe or unsafe conditions by comparing the location of each crew member 402 to a database of predetermined locations. The predetermined conditions can be modified to take account of rig configuration, size of crew, operation being undertaken, individual company safety policies, and/or any other factors as may be appropriate.

RFID tag 302 is, in some embodiments, embedded in a hard hat 300. In other embodiments, RFID tag 302 is embedded in another device associated with an individual crew member 402. For example, RFID 302 may be worn inside clothing like "dog tags" or incorporated into other safety gear. Sensors 404 with wireless antennae 406 are located around rig 200 can constantly track and report the location of each RFID 302 signal associated with a crew member 402, and each RFID 302 may be separately identified with an individual crew member 402. Data from sensors 404 are transmitted via antennae 406 to a receiver comprising an antenna 412 and a modem 414. Data from modem 414 is fed to control panel 220 either directly or indirectly, where it is used by driller 408 to determine the location of the crew members 402. Control panel 220, for example, may display a light 410 when a crew member 402 is present at his assigned location, or additional electronic control logic and/or databases 416 can be provided in or associated with control panel 220 to compare the crew members 402 present and their locations with a predetermined set of parameters to advise driller 408 whether the needed personnel were present and in the location in which they were supposed to be for the operation being undertaken. In some embodiments of the present invention, derrick man 106 uses an RFID tag 302 either to supplement or to substitute for switch 10, although in most embodiments, it is envisioned that derrick man 106 would use switch 10 and no RFID tag, at least in part because of his location.

It will be appreciated that some configurations of the present invention provide a comprehensive approach to monitoring crew behavior and location. It will also be appreciated that some configurations of the present invention provide apparatus to make drilling operations safer, and/or that assist in changing the behavior of personnel to make safety systems more effective.

While the invention has been described in terms of various specific embodiments, those skilled in the art will recognize that the invention can be practiced with modification within the spirit and scope of the claims.

What is claimed is:

1. A safety apparatus for personnel on an oil drilling rig, said apparatus comprising a cylindrical quick disconnect switch having a receptacle and a plunger, wherein the receptacle comprises an open circuit pair of electrical wires, the plunger is configured to attach to a derrick man, and said plunger and said receptacle are configured to mate when said plunger is inserted into said receptacle and to remain frictionally mated until pulled apart, said mating resulting in closing the circuit between the pair of electrical wires.

2. A safety apparatus in accordance with claim 1 wherein said plunger is anchored to a safety vest and said receptacle is anchored to a portion of the oil drilling rig, so as to permit said plunger and said receptacle to be joined together only when a piece of safety protection equipment is properly in place.

3. A safety apparatus in accordance with claim 1 wherein said plunger is frictionally mated using at least one O-ring.

4. A safety apparatus in accordance with claim 1 wherein said plunger includes a hole configured to attach to a safety vest via a lanyard.

5. A safety apparatus in accordance with claim 1 wherein said receptacle includes a cap through which said open circuit pair of electrical wires pass and a female portion having a pair of posts in electrical communication with said open circuit pair of wires, and said plunger includes a female portion having a conductive, flat annulus configured to resiliently contact both of said posts to complete the circuit between the pair of electrical wires.

6. A safety apparatus on an oil derrick, said apparatus comprising:

a plurality of radio frequency identification (RFID) tags, each RFID tag assigned to crew members on the oil derrick;

a plurality of sensors and/or antennae located on the oil derrick configured to track and report the location of each said RFID tag;

a control panel having at least one indicator, said control panel responsive to said location reports and said at least one indicator configured to indicate to a driller when needed crew members are present and in locations in which the crew members are supposed to be for an operation of the oil derrick being undertaken; and a quick-disconnect switch for a derrick man configured for use on a drill pipe stand, said control panel further being responsive to a signal controlled by said quick-disconnect switch, wherein said quick-disconnect switch is cylindrical and further comprises a receptacle and a plunger, wherein the receptacle comprises an open circuit pair of electrical wires, the plunger is configured to attach to the derrick man, and said plunger and said receptacle are configured to mate when said plunger is inserted into said receptacle and to remain frictionally mated until pulled apart, said mating resulting in closing the circuit between the pair of electrical wires.

7. A safety apparatus in accordance with claim 6, wherein said plunger is anchored to a safety vest and said receptacle is anchored to a portion of an oil drilling rig, so as to permit said plunger and said receptacle to be joined together only when a piece of safety protection equipment is properly in place.

8. A safety apparatus in accordance with claim 6, wherein said plunger is frictionally mated using at least one O-ring.

9. A safety apparatus in accordance with claim 6 wherein said plunger includes a hole configured to attach to a safety vest via a lanyard.

10. A safety apparatus in accordance with claim 6 wherein said receptacle includes a cap through which said open circuit pair of electrical wires pass and a female portion having a pair of posts in electrical communication with said open circuit pair of wires, and said plunger includes a female portion having a conductive, flat annulus configured to resiliently contact both of said posts to complete the circuit between the pair of electrical wires.

* * * * *